US005657859A

United States Patent [19]

Concannon et al.

[11] Patent Number: 5,657,859

[45] Date of Patent: *Aug. 19, 1997

[54] STRUCTURE FOR ADAPTING THE HEIGHT OF AN ALARM ACTUATOR

[75] Inventors: Richard F. Concannon, Massapequa, N.Y.; Benjamin W. Exner, Milford, Pa.; Howard Kogen, Woodside, N.Y.

[73] Assignee: Firecom, Inc., Woodside, N.Y.

[ * ] Notice: The term of this patent shall not extend beyond the expiration date of Pat. No. 5,448,031.

[21] Appl. No.: 456,961

[22] Filed: Jun. 1, 1995

Related U.S. Application Data

[63] Continuation-in-part of Ser. No. 250,557, May 27, 1994, Pat. No. 5,448,031.

[51] Int. Cl.[6] ..... H01H 15/24

[52] U.S. Cl. ..... 200/331

[58] Field of Search ..... 200/331, 334, 200/518

[56] References Cited

U.S. PATENT DOCUMENTS

| | | | |
|---|---|---|---|
| D. 274,972 | 8/1984 | Mann, Jr. | 200/331 X |
| 2,389,220 | 11/1945 | Tredeau . | |
| 2,668,456 | 2/1954 | Meistrell . | |
| 2,724,032 | 11/1955 | Coletta . | |
| 2,726,381 | 12/1955 | Verkuil . | |
| 2,775,674 | 12/1956 | Meder . | |
| 3,037,104 | 5/1962 | Rosenlund . | |
| 3,077,789 | 2/1963 | DeLashmutt . | |
| 3,339,051 | 8/1967 | DeVall . | |
| 3,581,037 | 5/1971 | Schiffelbein . | |
| 3,916,134 | 10/1975 | Hansen . | |
| 4,295,026 | 10/1981 | Williams et al. | 200/331 |
| 4,296,291 | 10/1981 | Johnson | 200/331 |
| 4,388,508 | 6/1983 | Wilson . | |
| 4,590,345 | 5/1986 | Marshell . | |
| 4,705,924 | 11/1987 | Hevoyan | 200/331 |
| 4,771,145 | 9/1988 | Davis, Jr. | 200/331 |
| 5,055,645 | 10/1991 | Hull et al. . | |
| 5,219,066 | 6/1993 | Jameson | 200/331 X |

*Primary Examiner*—Renee S. Luebke

*Attorney, Agent, or Firm*—Morgan & Finnegan, L.L.P.

[57] ABSTRACT

A device and method for adjusting the height at which an alarm pull-station may be actuated. The device and method involve the use of a mechanical system in mechanical communication with an alarm pull-station. The height at which existing alarm pull-stations may be actuated is decreased without structurally, mechanically or electronically altering existing pull-stations. The device for adjusting the height at which an alarm pull-station may be actuated includes an alarm trigger operatively engageable with an alarm trigger lever of the pull-station, a rod operatively associated with the alarm trigger, and a mounting portion operatively associated with the rod, wherein the mounting portion is attached to a fixed structure and the device is disposed externally of the alarm pull-station. A spring is used between elements of the device to inhibit any unwanted downward movement of the device. Two spacers are used to engage a cover on the device to prevented unwanted withdrawal of the installed device from the alarm pull-station.

21 Claims, 12 Drawing Sheets

STRUCTURE FOR ADAPTING THE HEIGHT OF AN ALARM ACTUATOR

This application is a continuation-in-part of U.S. patent application Ser. No. 08/250,557, filed May 27, 1994, U.S. Pat. No. 5,448,031.

BACKGROUND OF THE INVENTION

I. Field of the Invention

The present invention relates generally to a method and structure for adapting the height at which an alarm may be actuated without altering the structure of existing alarm pull-stations.

II. Description of the Related Art

Recently, various building codes and federal regulations have been amended and/or enacted to establish new requirements regarding the accessibility of fire alarm pull-stations to individuals, handicapped individuals in particular, who cannot reach an alarm pull-station. Traditionally, alarm pull-stations have been mounted in the range of 50 to 62 inches (1.27 m to 1.58 m) above the floor. Under new government regulations, manual stations for fire alarms must be mounted at a centerline position no greater than 48 inches (1.22 m) above the floor. As such, building owners are faced with the prospect of investing considerable time and resources to move their existing alarm pull-stations, patch old junction pull-stations, wire new junction pull-stations and reinstall pull-stations at the mandated height. Such a procedure is particularly burdensome when the original alarm pull-station was installed on a structure, such as marble wall surface, which cannot be easily and/or attractively patched.

Various devices and techniques have been used in the past to adjust the height at which an alarm may be actuated. For example, in U.S. Pat. No. 5,219,066, a wall-mounted alarm switch assembly with an adjustable height actuator is disclosed. However, the disclosed device is intended as a complete replacement of existing pull-stations. As such, the device disclosed in U.S. Pat. No. 5,219,066 fails to alleviate the time and expense associated with removing existing pull-stations and replacing them with new alarm pull-stations.

Other devices and methods have also been used to adjust the height at which a light switch may be actuated. For example, in U.S. Pat. Nos. 2,389,220, 2,668,456 and 3,581,037, various devices and methods are disclosed to alter the height at which a light switch may be actuated. However, these and other similar concepts suffer from a number of disadvantages. In particular, these devices require that existing light switch structure either be replaced or used to secure a height-adjusting device within the light switch. As such, structural changes are made to the light switch structure. Fire alarm pull-stations are regulated by various government agencies and cannot be altered structurally, mechanically or electronically. As such, the devices disclosed in these patents are clearly inappropriate for adjusting the height at which existing alarm pull-stations may be actuated.

Other attempts have been made to adjust the height at which a light switch can be actuated. However, these attempts also fail to address the problems associated with adjusting the height at which an alarm pull-station may be actuated. For example, in U.S. Pat. No. 5,055,645, a rotatable light switch extension is disclosed to (1) enable children to actuate a light switch and (2) enable parents to rotate the extension so that, if desired, the handle may be rotated to a position where a child is unable to reach the extension. Such a device, therefore, is clearly inappropriate for extending fire alarm pull-stations as it could not ensure compliance, at all times, with the height requirements of the new fire alarm regulations.

OBJECTS OF THE INVENTION

It is therefore an object of the present invention to overcome the aforementioned disadvantages of the related art.

It is an object of the present invention to provide a simple and cost-effective solution to problems encountered in complying with building codes and government regulations for actuating alarm pull-stations.

It is a further object of the present invention to provide an apparatus and method for adjusting the height at which existing alarm pull-stations may be actuated.

It is a further object of the present invention to provide inexpensive mechanical arrangements to adapt the height of existing alarm pull-stations.

It is a further object of the present invention to maintain the structural, mechanical and electrical integrity of existing approved alarm pull-stations, thereby preserving the original internal operation, position and acceptability of the existing pull-stations.

It is a further object of the present invention to provide such an apparatus for adjusting the height at which an alarm pull-station may be actuated, which has some form of structure to prevent unwanted downward movement of the apparatus and an accidental withdrawal of the apparatus from the pull-station.

SUMMARY OF THE INVENTION

The present invention recognizes the aforementioned problems in providing extensions to adjust the height at which an alarm pull-station may be actuated and provides novel solutions thereto which overcome many deficiencies and disadvantages of presently known devices and techniques.

It is a feature of the present invention to provide a cost-effective device and method for complying with building codes and government regulations for actuating alarms. In particular, it is a feature of the present invention to provide inexpensive mechanical arrangements to adjust the height at which existing alarm pull-stations may be actuated, without structurally altering approved construction of the alarm pull-stations.

The present invention achieves the aforementioned objects and advantages through the use of a mechanical device to adjust the height at which an alarm pull-station may be actuated without needing to alter the position, structure or internal operation of the alarm pull-station. In particular, the device includes an alarm trigger operatively engagable with an alarm trigger of the alarm pull-station, a rod operatively associated with the alarm trigger, a handgrip operatively associated with the alarm trigger, and a mounting portion operatively associated with the rod, the mounting portion being attached to a fixed structure and the device being disposed externally of the alarm pull-station. The device may also include a second rod and a cross bar extending between the first and second rods.

In a first embodiment of the present invention, the apparatus contains a T-shaped structure to serve as the alarm trigger, wherein at least a portion of the T-shaped structure is disposed between the alarm pull-station and the alarm pull-station trigger lever such that the T-shaped structure forces the alarm trigger lever away from the alarm pull-station as the T-shaped structure is pulled downwardly along a fixed structure.

In a second embodiment of the present invention, the apparatus utilizes a camming surface to serve as the alarm trigger. In particular, an at least substantially spherically shaped cam structure is used to serve as the alarm trigger.

Other embodiments of the present invention include a spring which is used to inhibit any unwanted downward movement of the apparatus, and a spacer structure to prevent an accidental withdrawal of the apparatus from the pull-station.

The present invention is also directed to a method for adjusting the height at which an alarm pull-station may be actuated, including the steps of: maintaining the alarm pull-station in a structurally unaltered condition, disposing an elongated apparatus externally of said alarm pull-station, placing the elongated apparatus in external communication with an external portion of the alarm trigger of the alarm pull-station, and securing the alarm pull-station to a fixed structure.

Further objects, advantages and applications of the present invention will become apparent to those skilled in the art upon a review of the accompanying description of the preferred embodiments for practicing the invention, in conjunction with the accompanying drawings.

BRIEF DESCRIPTION OF THE DRAWINGS

The description herein makes use of the accompanying drawings wherein like reference numbers refer to like parts throughout the various views and wherein.

DETAILED DESCRIPTION OF THE PREFERRED EMBODIMENTS OF THE PRESENT INVENTION

Figure 1:
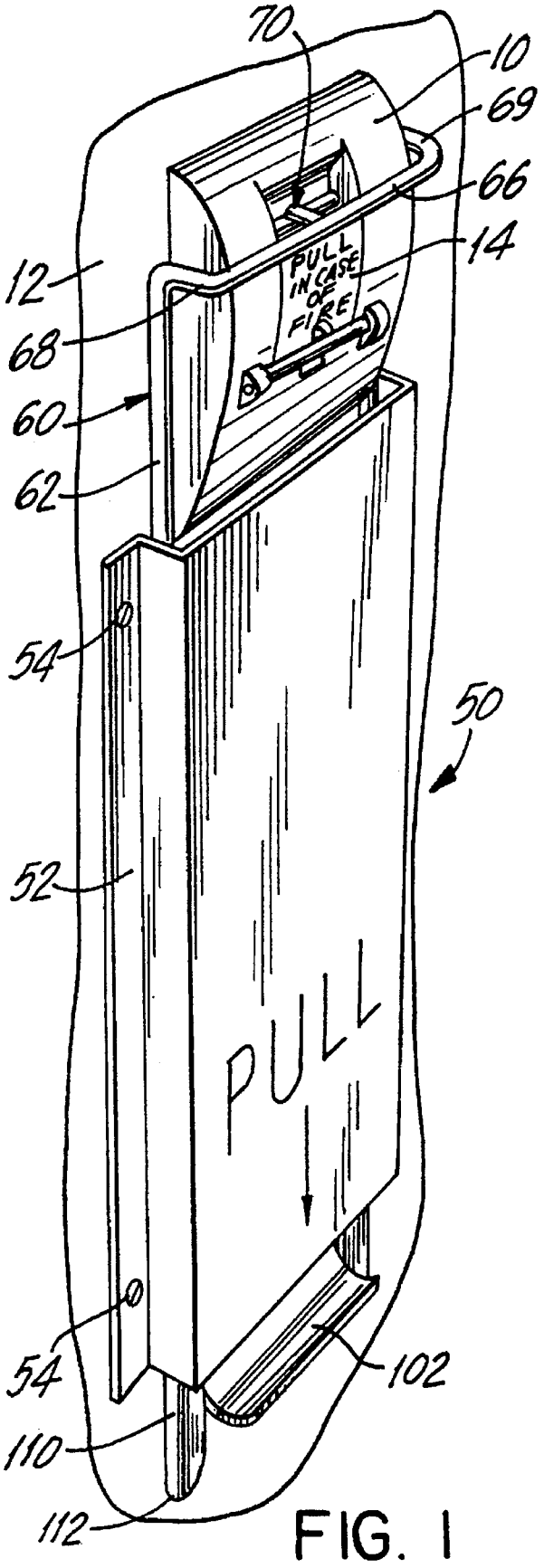
FIG. 1 illustrates a perspective view of a first illustrative embodiment of the present invention in communication with a standard Edwards™ alarm pull-station during a non-emergency condition.

Referring now to the drawings, several embodiments of the present invention will now be described. The device 50 of a first embodiment of the present invention is depicted in FIGS. 1–5 as applied to a standard Edwards™ alarm pull-station 10, each of these devices being described in greater detail below. In general, device 50 is an elongated apparatus which serves as an adapter to reduce the height at which the pull-station 10 may be actuated.

Figure 2:
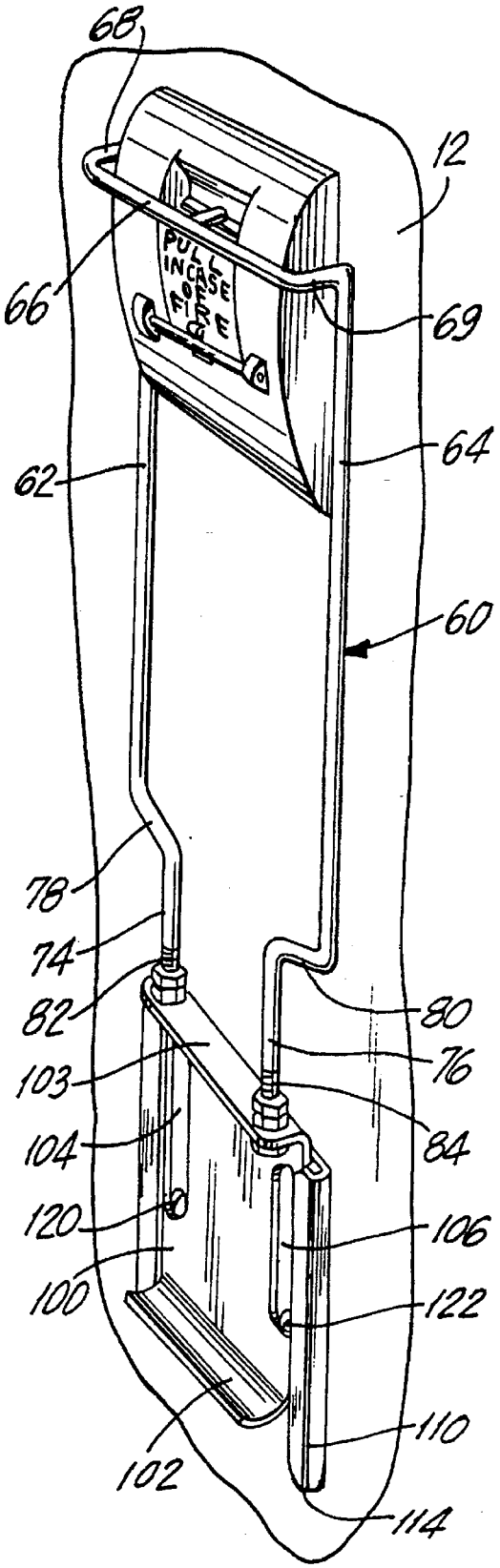
FIG. 2 illustrates an opposite perspective view of the first illustrative embodiment of FIG. 1 with the apparatus cover removed.
Figure 3:
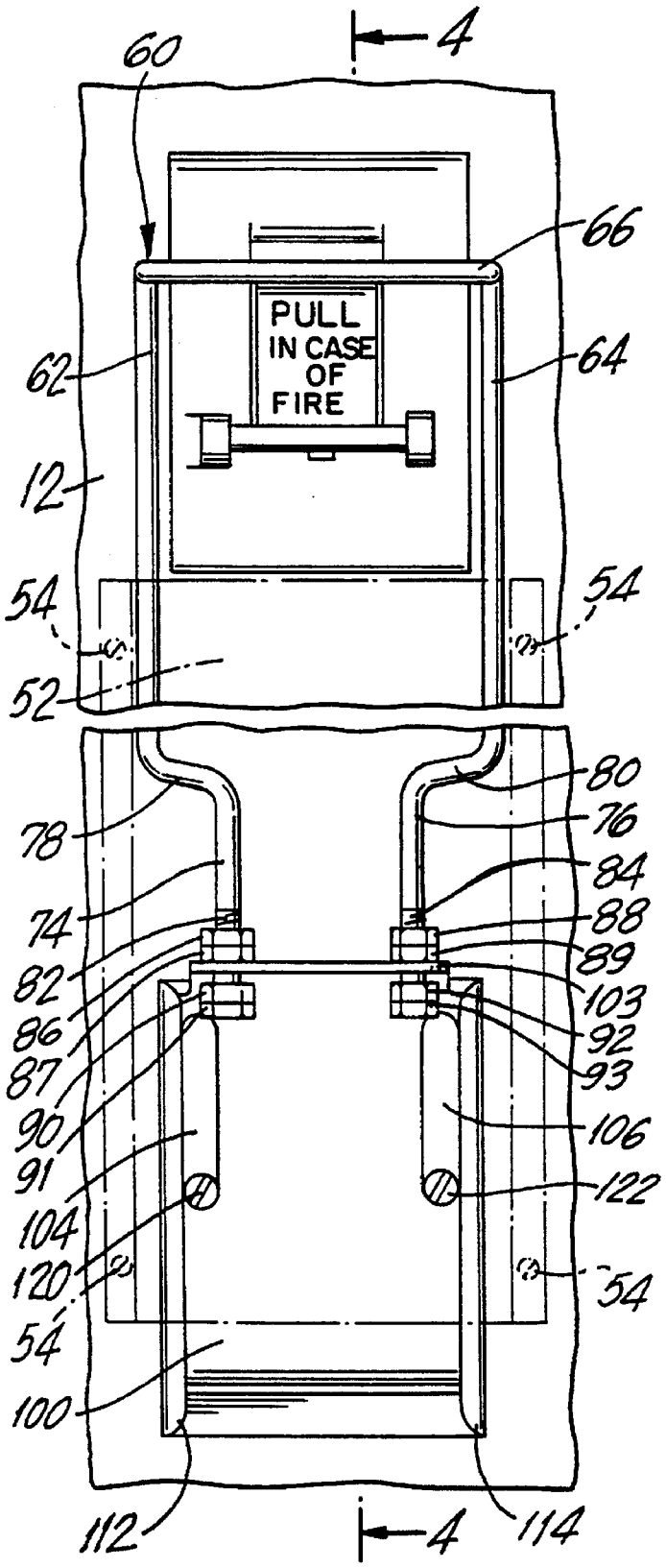
FIG. 3 illustrates a front plan view of the first illustrative embodiment of FIG. 1.
Figure 4:
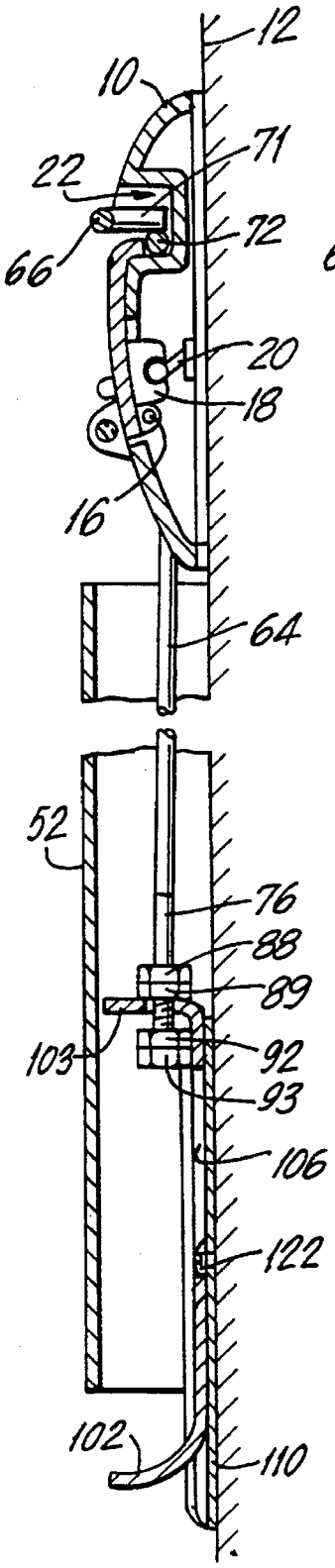
FIG. 4 illustrates a side view of the first illustrative embodiment of the present invention along line 4—4 of FIG. 3.
Figure 4A:
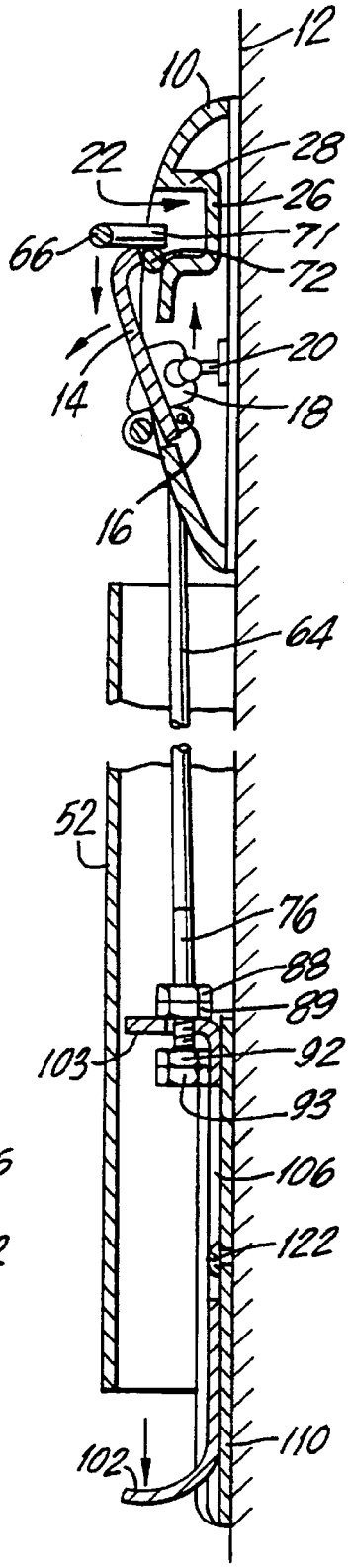
FIG. 4*a* illustrates a side view of the first illustrative embodiment of the present invention as it is being actuated to trigger an alarm during an emergency condition.
Figure 4B:
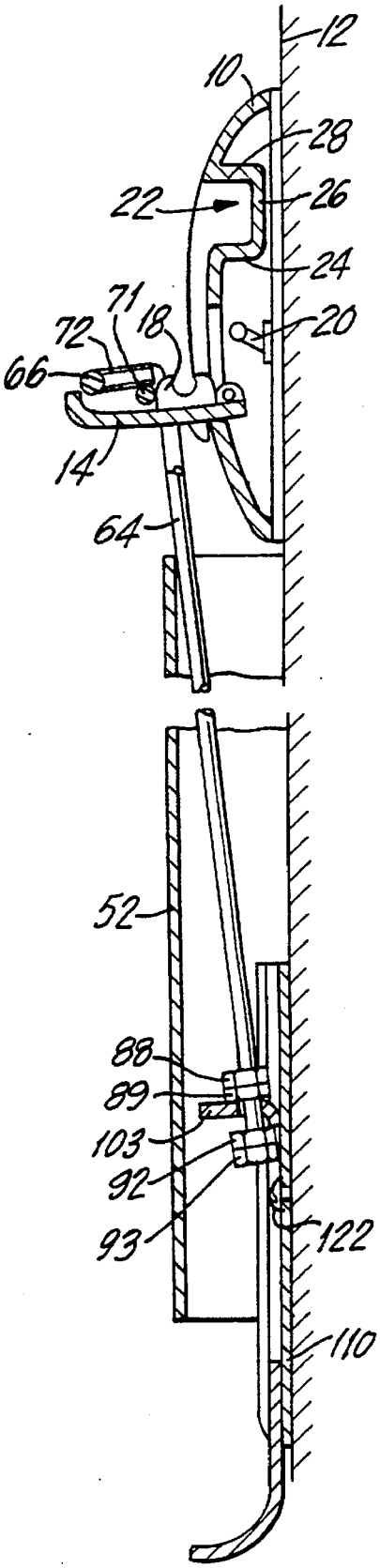
FIG. 4*b* illustrates a side view of the first illustrative embodiment of the present invention along line 4*b*—4*b* of FIG. 3*a*.

With continuing reference to FIGS. 1–5, pull-station 10 is a structurally unaltered Edwards™ alarm pull-station as mounted to a wall or other fixed structure 12. As best seen in FIGS. 4–4*b*, pull-station 10 has an alarm trigger lever 14 configured to pivot about pivot 16. A U-shaped lug 18 is mounted to trigger lever 14 within pull-station 10 to interact with alarm switch 20. A trigger cavity 22, defined by walls 24, 26, and 28, is provided in pull-station 10 to allow a user's finger(s) (not shown) to actuate the alarm by rotating alarm trigger lever 14 about pivot 16. Walls 24, 26 and 28 prevent access to internal components within alarm pull-station 10. With continuing reference to FIG. 4*a*, as alarm trigger 14 pivots, U-shaped lug 18 forces the alarm switch 20 in the upward direction thereby actuating the alarm. The structure and internal operation of the pull-station 10 is unaffected by the interaction with device 50 of the present invention. The structure and operation of pull-station 10 is described in greater detail in U.S. Pat. No. 2,726,381, herein incorporated by reference.

Device 50 generally comprises a cover 52, a rod structure 60, a slider 100 and a mounting plate 110, each of which will now be described in greater detail below.

As shown in FIG. 1, cover 52 is mounted to a wall or other fixed structure 12 via-retaining screws 54. Cover 52 serves to enclose and protect portions of rod structure 60, slider 100 and mounting plate 110.

Figure 5:
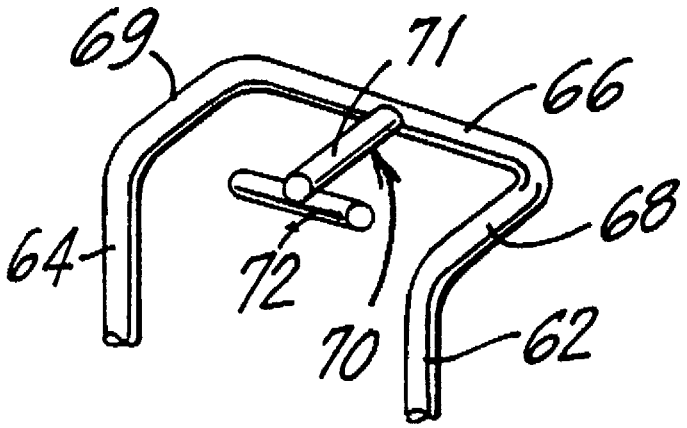
FIG. 5 illustrates a perspective view of the top portion of the first illustrative embodiment of the present invention.

As shown in FIG. 2, rod structure 60 comprises a series of rods to mechanically adapt pull-station 10 to alter the height at which an alarm may be actuated. Rod structure 60 has a first rod 62 and a second rod 64 which are mechanically coupled by cross bar 66 via connecting portions 68 and 69. As best seen in FIG. 5, rod structure 60 also contains a T-shaped alarm triggering protrusion 70 comprising portions 71 and 72 which extend from cross bar 66. Portion 72 is dimensioned to be received between the alarm pull-station 10 and the alarm trigger lever 14. Rod structure 60 also contains rod extensions 74, 76 which extend, respectively, from the first rod 62 and the second rod 64 via connecting portions 78 and 80. Rod extensions 74, 76 contain threaded portions 82, 84 for engagement with a series of bolts 86–93 to mechanically couple the rod structure to a slider 100.

Figure 3A:
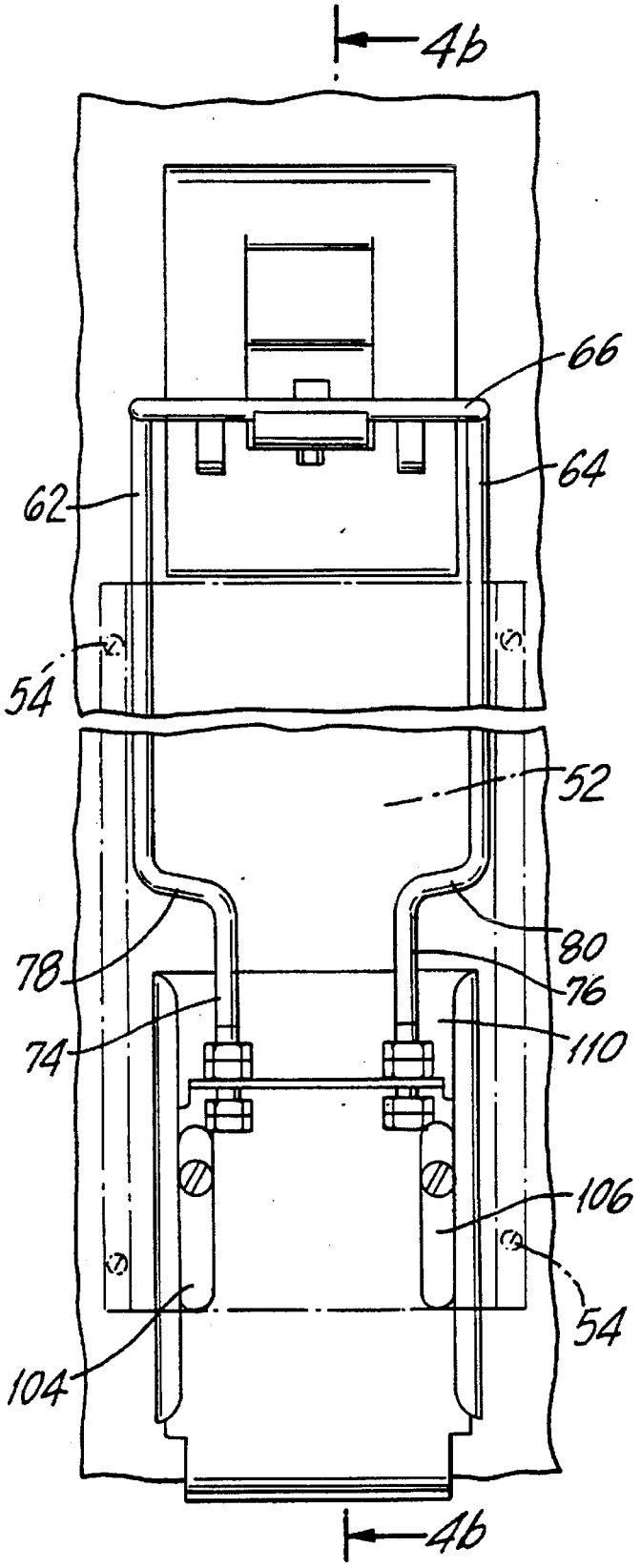
FIG. 3*a* illustrates a front plan view of a first illustrative embodiment of the present invention in communication with a standard Edwards™ alarm pull-station after the alarm has been triggered during an emergency condition.

As shown in FIGS. 2–3*a*, slider 100 contains a hand-gripping portion 102, a rod-engaging portion 103 and two elongated slots 104, 106. Hand-gripping portion 102 is preferably outwardly curved to facilitate manipulation by a user. Rod-engaging portion 103 has two holes for receiving threaded portions 82, 84 of rod structure 60.

With continuing reference to FIGS. 2–3*a*, mounting plate 110 contains two U-shaped grooves 112, 114, to slidably couple slider 100 with mounting plate 110. Retaining screws 120, 122 fasten mounting plate 110 to the wall or other fixed structure 12. The heads of retaining screws 120, 122 are received within elongated slots 104, 106 of slider 100 to guide slider 100 as it moves rod structure 60 with respect to mounting plate 110. The interaction of retaining screws 120, 122 with slider 100 also prevents slider 100 from sliding out of U-shaped grooves 112, 114 of mounting plate 110.

In this embodiment of the present invention, device 50 has the following approximate dimensions: cover 52 has a length of 11 inches and a width of 5 inches (29×12.7 cm); rod structure 60 is made of a ¼ inch (0.6 cm) diameter rod in which rods 62 and 64 are 8 inches (20.3 cm) long, cross bar 66 is 3½ inches (8.9 cm) long, connecting portions 68, 69 are ¼ of an inch (1.9 cm) long, protrusion 71 is ½ of an inch (1.3 cm) long, protrusion 72 is 1¼ inches (3.2 cm) long, rod extensions 74, 76 are 3½ inches (8.9 cm) long, connecting portions 78, 80 are 1 inch (2.5 cm) long and threaded portion 82, 84 are 1¼ inches (3.2 cm) long; slider 100 is 4 inches by 2¾ inches (10.1×7 cm) in which slots 104, 106 are 2 by ⅜ inches (5×1 cm); and mounting plate 110 is 4½ by 3 inches (11.4×7.6 cm) in which U-shaped groves 112, 114 are ¼ inch (0.6 cm) deep. In addition, device 50 is preferably made of steel, although it is to be understood that other suitable materials and dimensions may be used.

In use during an emergency condition, a user may pull either the alarm trigger lever 14 or the hand-gripping portion 102. If the hand-gripping portion 102 is pulled in the direction indicated in FIG. 1, the device 50 will slide from the non-emergency condition depicted in FIG. 3 to the emergency condition depicted in FIG. 3*a*. With reference to FIGS. 4–4*b*, as the device 50 slides to the emergency condition, T-shaped alarm triggering protrusion 70 engages the alarm trigger lever 14 of pull-station 10 to rotate about pivot 16, thereby forcing the alarm switch 20 in an upward direction to trigger the alarm.

To mechanically couple the device 50 with alarm pull-station 10, the installation procedure involves the following steps: (1) placing portion 72 of T-shaped protrusion 70 within trigger cavity 22 so that portion 72 rests on wall 24 to facilitate engagement with alarm trigger lever 14, (2) placing slider 110 within U-shaped grooves 112, 114 of mounting plate 110, (3) arranging bolts 86–93 to couple rod structure 60 with slider 100 and mounting plate 110, while providing sufficient space between bolts 87 and 90 as well as 89 and 92 to allow rod structure 60 to rotate to the position depicted in FIG. 4*b*, (4) fixing mounting plate 110 to structure 12 via screws 120, 122, and (5) fixing cover 52 to structure 12 via screws 54. During placement of portion 72 within trigger cavity 22 (Step 1), alarm trigger 14 may be slightly displaced. However, device 50 is disposed externally of walls 24, 26 and 28 of alarm pull-station 10, thereby preserving the original internal operation and acceptability of the pull-station 10. Therefore, alarm pull-station 10 remains structurally unaltered during this coupling procedure and continues to operate in its original manner.

With reference to FIGS. 6–9, the device 250 of a second embodiment of the present invention as applied to a standard Mirtone™ alarm pull-station 210 is shown, each of these devices being described in greater detail below. In general, device 250 is an elongated apparatus which serves as an adapter to reduce the height at which the pull-station 210 may be actuated.

With continuing reference to FIG. 6–9, pull-station 210 is a structurally unaltered Mirtone™ alarm pull-station as mounted to a wall or other fixed structure 212. As best seen in FIGS. 7*a*–8*b*, pull-station 10 has an alarm trigger lever 214 configured to pivot about pivot 216. A U-shaped retaining portion 218 is mounted within pull-station 210 to retain alarm trigger lever 214 via retaining portion 219 to maintain alarm switch 220 in a non-emergency condition. As best seen in FIGS. 8*a*–8*b*, a trigger cavity 222, as defined by alarm trigger lever 214 and plate 224, is provided in pull-station 210 to allow a user's finger(s) (not shown) to actuate the alarm by rotating alarm trigger lever 214 about pivot 216. Alarm trigger lever 214, retaining portion 219 and plate 224 prevent access to internal components within pull-station 210 during the non-emergency condition depicted in FIGS. 6, 7*a* and 8*a*. As lever 214 rotates, alarm switch 220 is released thereby actuating the alarm. The structure and internal operation of the pull-station 210 is unaffected by the interaction with device 250 of the present invention.

Device 250 generally comprises a cover 252, a rod structure 260, a slider 300 and a mounting plate 310, each of which will now be described in greater detail below.

Figure 6:
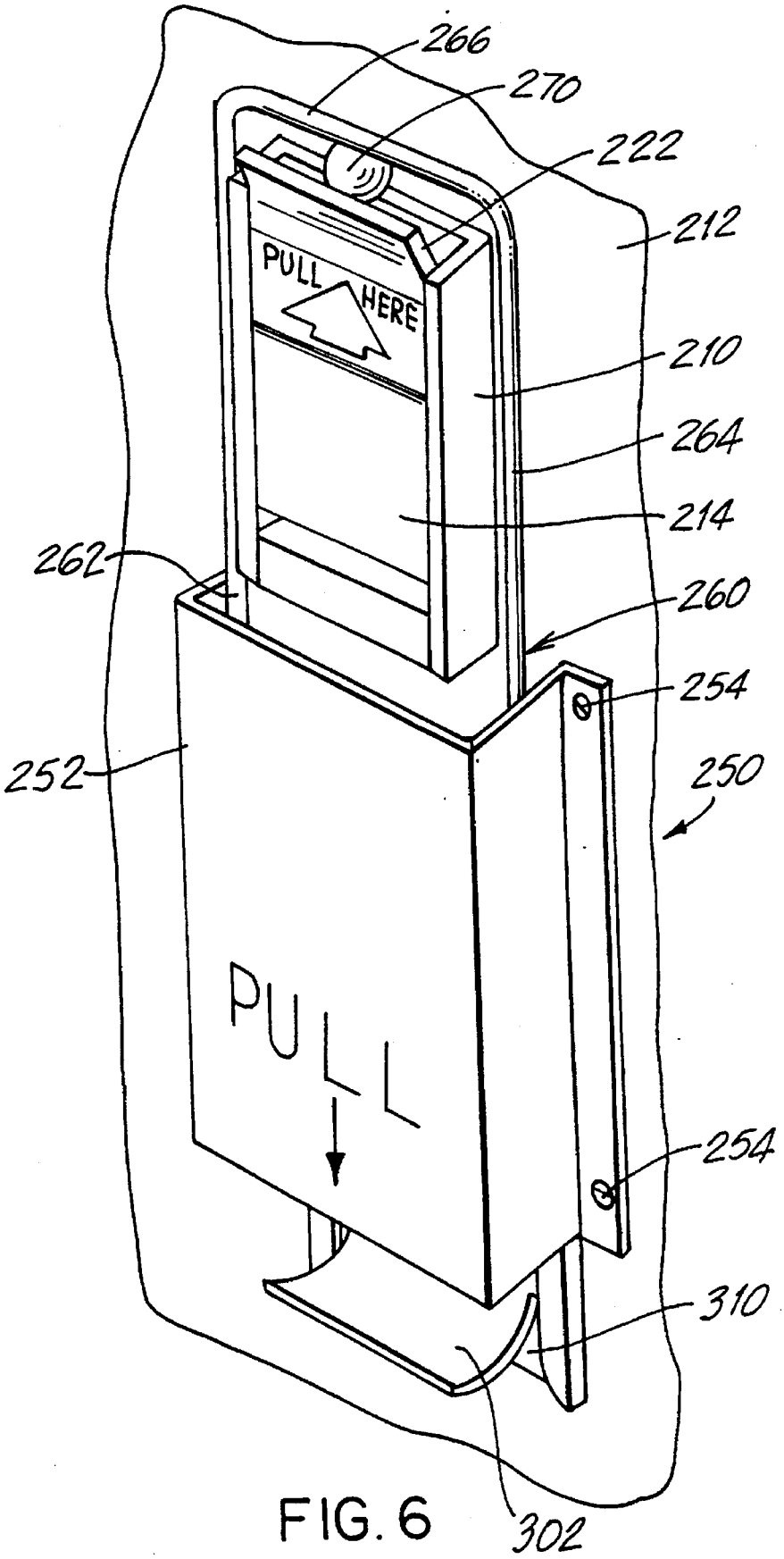
FIG. 6 illustrates a perspective view of a second illustrative embodiment of the present invention in communication with a standard Mirtone™ alarm pull-station during a non-emergency condition.

As shown in FIG. 6, cover 252 is mounted to wall or other fixed structure 212 via retaining screws 254 to enclose and protect portions of rod structure 260, slider 300 and mounting plate 310.

Figure 7A:
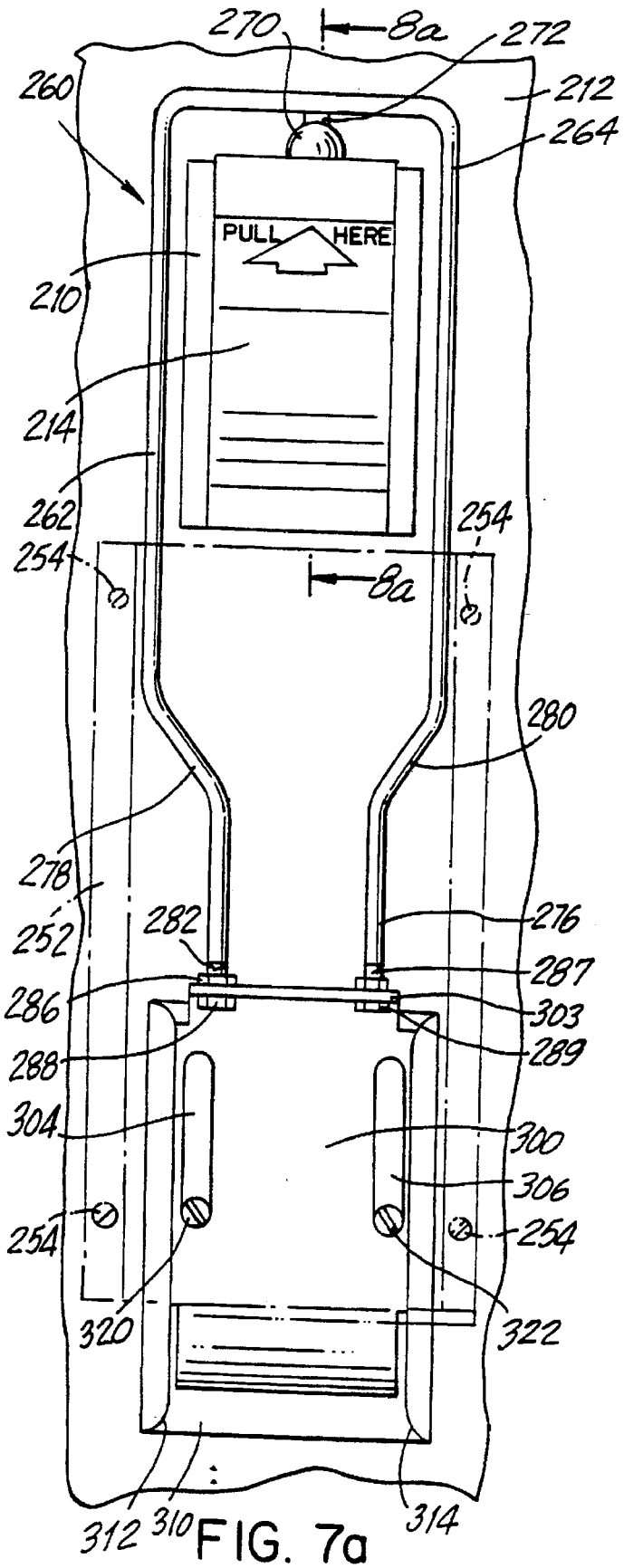
FIG. 7*a* illustrates a front plan view of the second illustrative embodiment of FIG. 6.
Figure 7B:
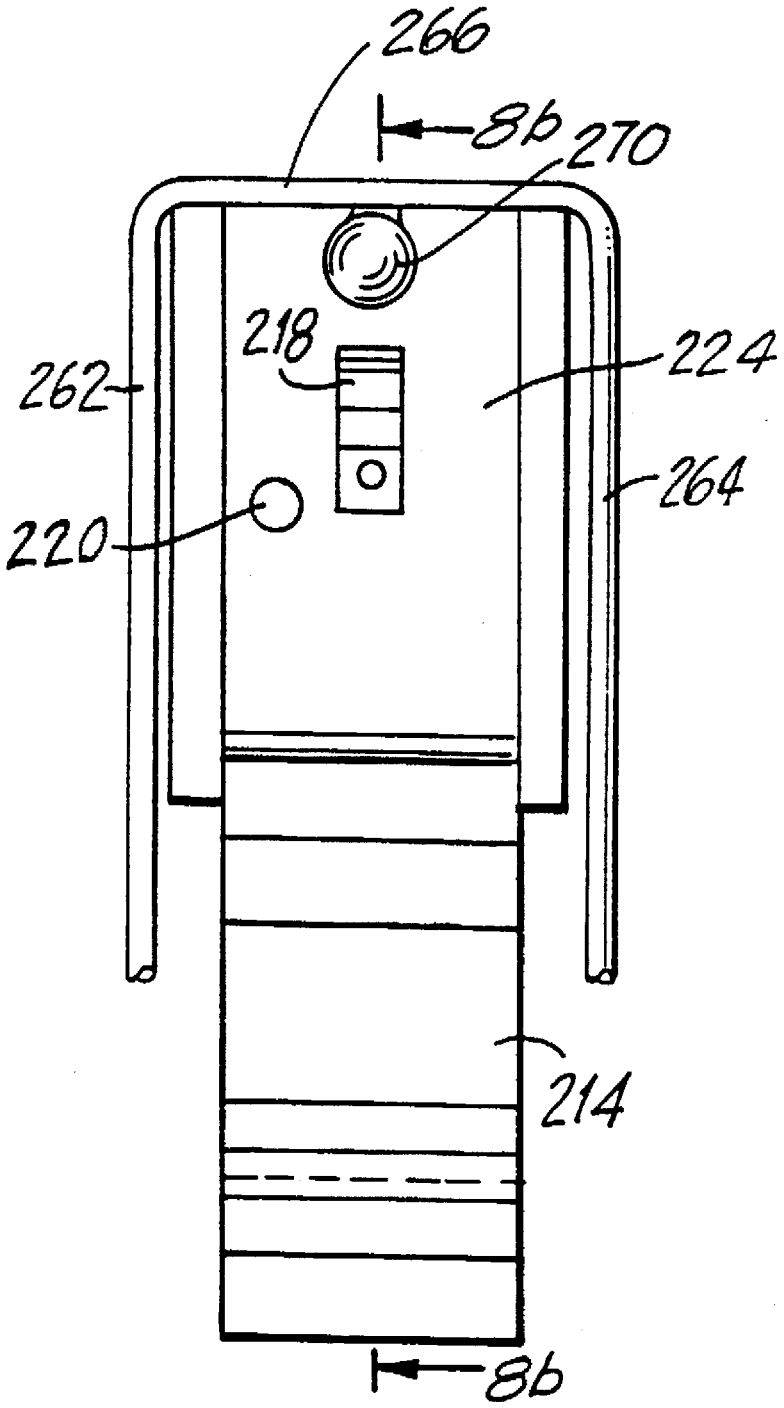
FIG. 7*b* illustrates a front plan view of the top portion of the second illustrative embodiment of the present invention after the alarm has been triggered during an emergency condition.
Figure 8B:
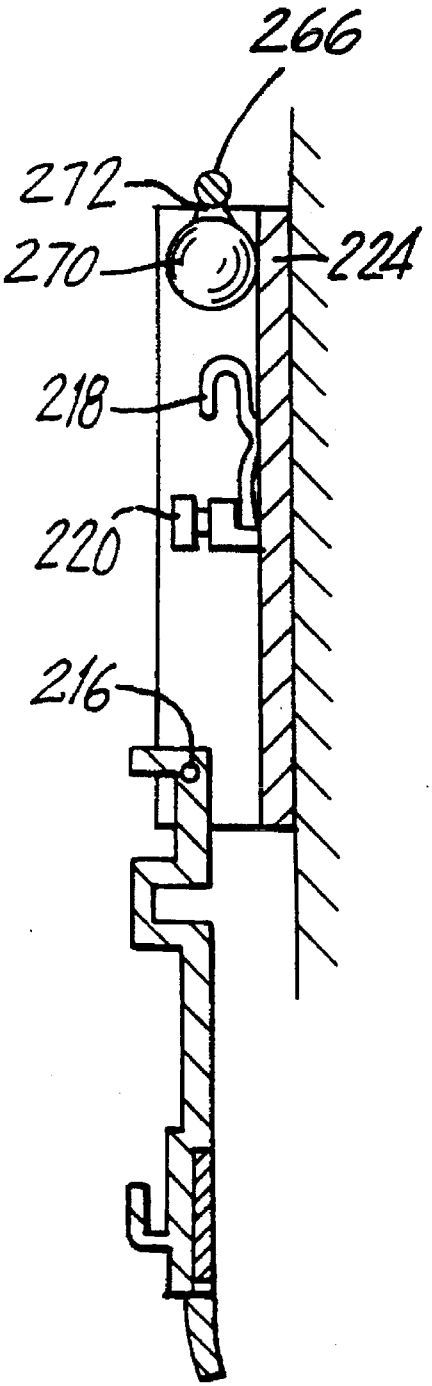
FIG. 8*b* illustrates a side view of the top portion of the second illustrative embodiment of the present invention along line 8*b*—8*b* of FIG. 7*b*.
Figure 8A:
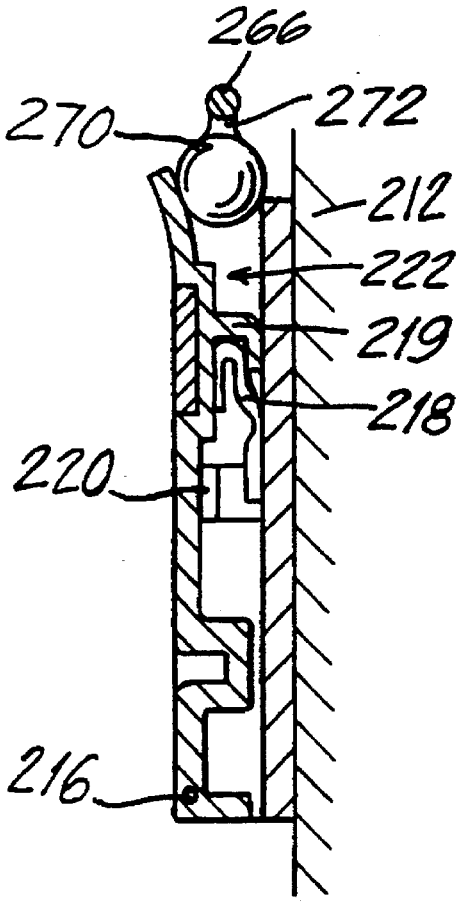
FIG. 8*a* illustrates a side view of the top portion of the second illustrative embodiment of the present invention along line 8*a*—8*a* of FIG. 7*a*.
Figure 9:
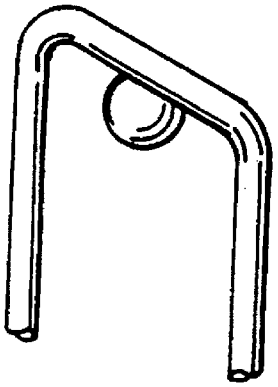
FIG. 9 illustrates a perspective view of the top portion of the second illustrative embodiment of the present invention.

As shown in FIG. 7*a*, rod structure 260 comprises a series of rods to mechanically adapt the height at which an alarm may be actuated. Rod structure 260 has a first rod 262 and a second rod 264 which are mechanically coupled by cross bar 266. As best seen in FIGS. 7*a*–9, rod structure 260 also contains a spherically shaped alarm triggering protrusion 270 and protrusion 272 which extend from cross bar 266. Protrusion 270 has a camming surface for engagement with alarm lever 214. With continuing reference to FIG. 7*a*, rod structure 260 also contains rod extensions 274, 276 which extend, respectively, from the first rod 262 and the second rod 264 via connecting portions 278 and 280. Rod extensions 274, 276 contain threaded portions 282, 284 for engagement with a series of bolts 286–289 to mechanically couple the rod structure 260 to a slider 300.

Slider 300 and mounting plate 310 are structurally and functionally identical to slider 100 and mounting plate 110 of the first embodiment of the present invention.

With continuing reference to FIG. 7*a*, slider 300 contains a hand-gripping portion 302, a rod-engaging portion 303 and two elongated slots 304, 306. Hand-gripping portion 302 is preferably outwardly curved to facilitate manipulation by a user. Rod-engaging portion 303 has two holes for receiving threaded portions 282, 284 of rod structure 260.

With continuing reference to FIG. 7*a*, mounting plate 310 contains two U-shaped grooves 312, 314 to slidably couple slider 300 with mounting plate 310. Retaining screws 320, 322 fasten mounting plate 310 to the wall or other fixed structure 212. The heads of retaining screws 320, 322 are received within elongated slots 304, 306 of slider 300 to guide slider 300 as it moves rod structure 260 with respect to mounting plate 310. The interaction of retaining screws 320, 322 with slider 300 also prevents slider 300 from sliding out of U-shaped grooves 312, 314 of mounting plate 310.

Figure 11:
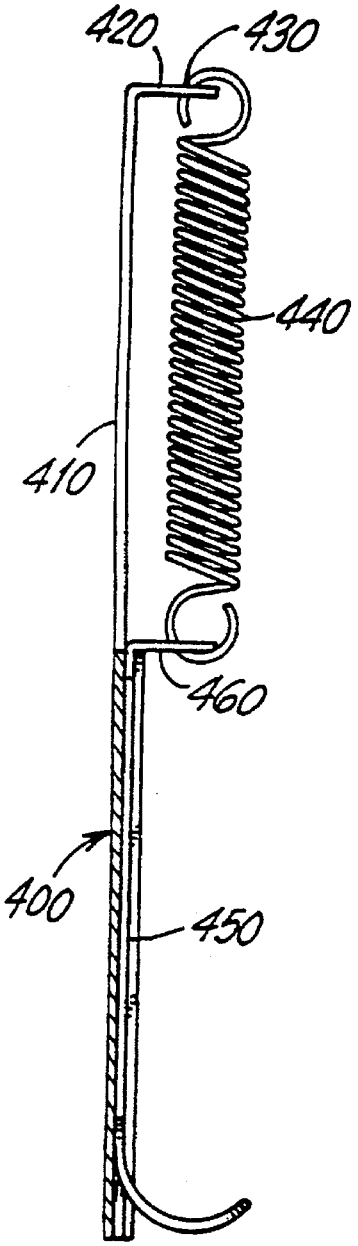
FIG. 11 illustrates a side view of FIG. 10 along line 11—11.
Figure 10:
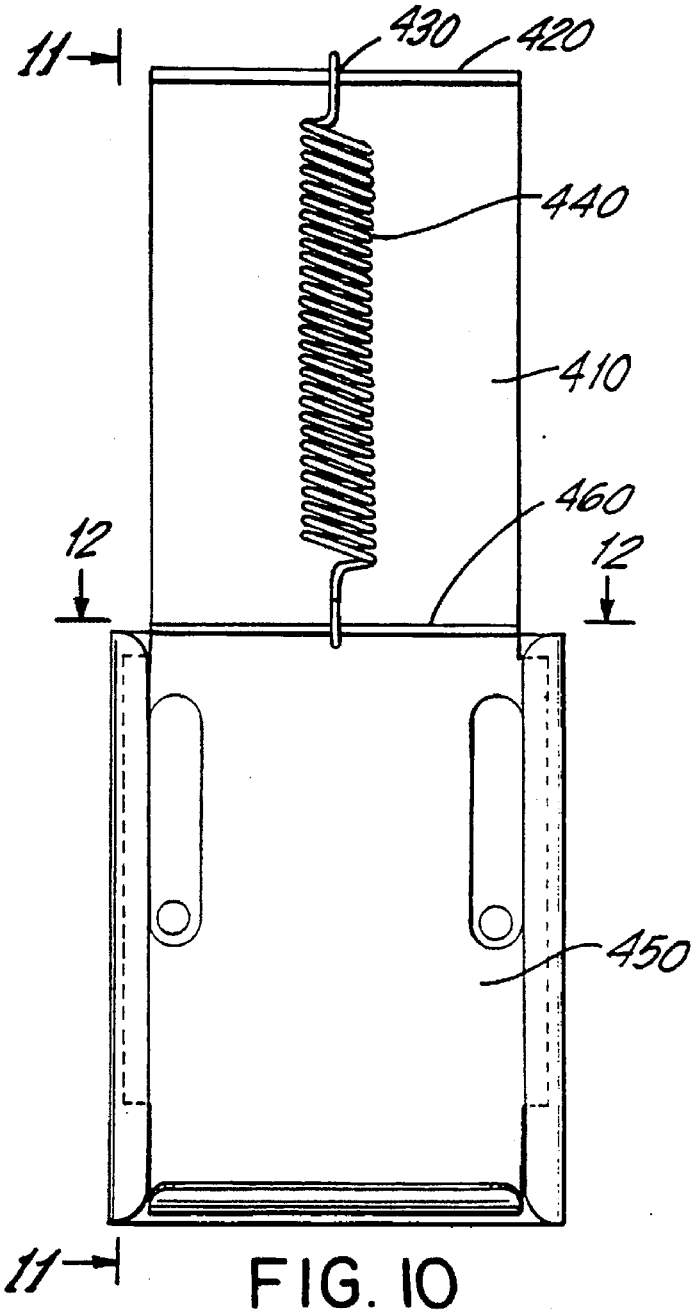
FIG. 10 illustrates a portion of another embodiment of the present invention.
Figure 12:
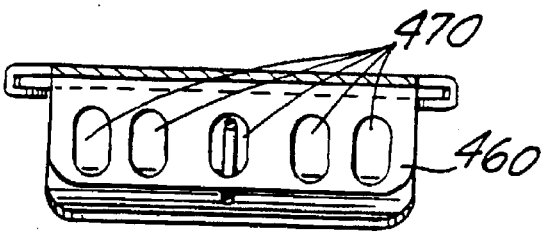
FIG. 12 illustrates a view of FIG. 10 along line 12—12.

With reference to FIGS. 10–12, a portion of an alternate embodiment of the present invention is shown. This portion includes a mounting plate 400 having an elongated portion 410. Elongated portion 410 has a spring-engaging panel 420 having a hole 430 through which a portion of a spring 440 is disposed. The slider 450 has an engaging portion 460 having a series of holes 470 for receiving the aforementioned rod-structure of the present invention and a portion of a spring 440. Spring 440 serves to pull spring-engaging panel 420 and engaging portion 460 together. As such, the spring 440 serves to eliminate any tendency for the slider 450 to slide downwardly (because of the weight of the slider 450 and rods, and/or any vibrational effects or incidental movement of the slider 450) during a non-emergency condition. During an emergency condition, a user must slide slider 450 downwardly with sufficient force to overcome the force of the spring 440.

Figure 13:
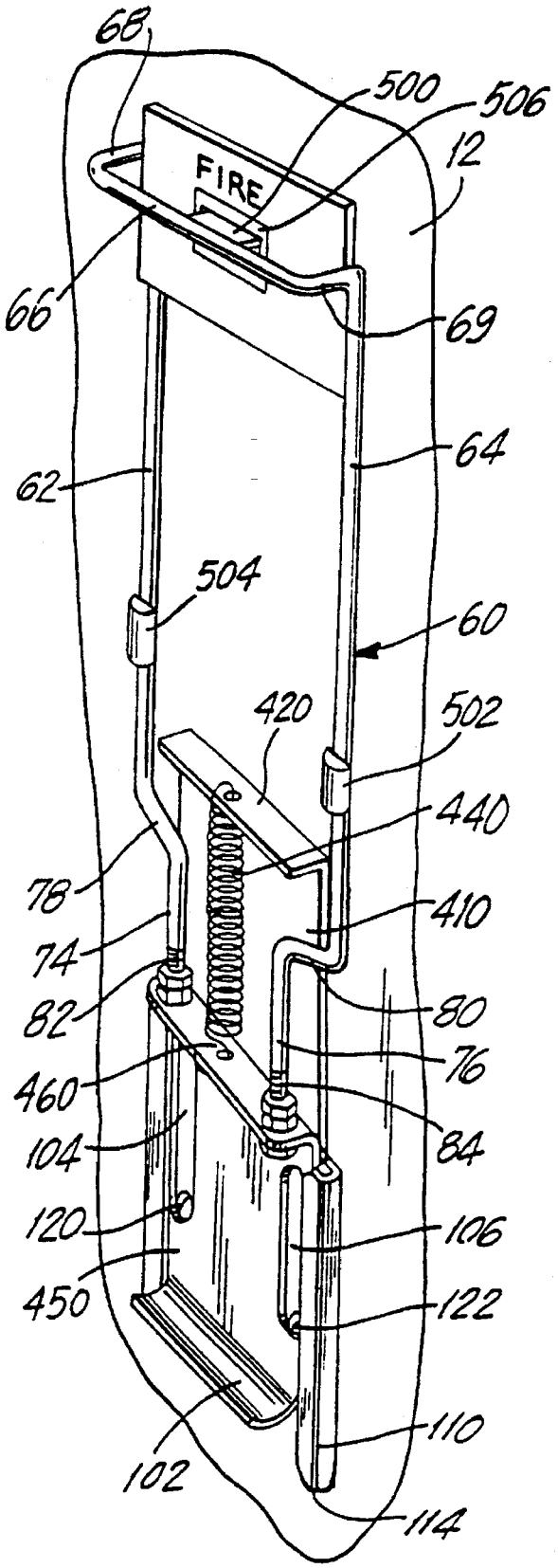
FIG. 13 illustrates a perspective view of another embodiment of the present invention.
Figure 14:
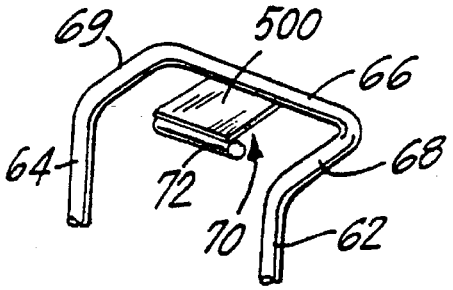
FIG. 14 illustrates a top portion of the embodiment of FIG. 13.

With reference to FIGS. 13 and 14, another embodiment of the present invention is shown. In this embodiment, common reference numerals have been maintained for elements which are common to earlier embodiments. In this embodiment, a rectangular plate 500 is used in lieu of portion 71. This rectangular plate 500 is preferably soldered under bar 66. This embodiment also includes spacers 502 and 504 which prevent the rod structure 60 and alarm-triggering protrusion 70 from being withdrawn from cavity 506 when a cover (not shown), such as the cover 52, is placed over the rod structure 60. In use, if such a cover is placed over the rod structure 60 and spacers 502, 504, the spacers 502, 504 will abut with the cover to prevent withdrawal of the alarm-triggering protrusion 70 from the cavity 506. Such an arrangement is preferably used with Faraday® Alarm Pull Stations (such as the Model No. FIGT Series) and Cerberus Pyrotronics® Pull Stations (such as model no. MS151). The earlier embodiments of the present invention are preferably used with Edwards® Pull Stations (such as the model No. 270A Series), Simplex® Pull Stations (such as Model No. 2099-9101, 2099-9102, 2099-9754, 2099-9755) and Gamewell® Pull Stations (such as the model No. M46-29).

In one embodiment of the present invention, device 250 has the following approximate dimensions: cover 252 has a length of 9 inches and a width of 4¾ inches (22.9×12.1 cm); rod structure 260 is made of a ¼ inch (0.6 cm) diameter rod in which rods 262 and 264 are 8 inches (20.3 cm) long, cross bar 266 is 3½ inches (8.9 cm) long, spherically shaped protrusion 270 has a diameter of ⅞ of an inch (2.2 cm), protrusion 272 is ⅛ of an inch long, extensions 274, 276 are 3 inches (7.6 cm) long, connecting portions 278, 280 are 1 inch long (2.5 cm) and threaded portions 282, 284 are 1 inch long (2.5 cm); slider 300 is 4 inches by 2¾ inches (10.1×7 cm) in which slots 104, 106 are 2 by ⅜ inches (5×1 cm); and mounting plate 310 is 4½ by 3 inches (11.4×7.6 cm) in which U-shaped groves 112, 114 are ¼ inch (0.6 cm) deep. In addition, device 250 is preferably made of steel although it is to be understood that other suitable materials and dimensions may be used.

In use during an emergency condition, a user may pull either the alarm trigger lever 214 or the hand-gripping portion 302. If the hand-gripping portion 302 is pulled in the direction indicated in FIG. 6, the device 250 will slide from the non-emergency condition depicted in FIG. 7*a* to the emergency condition depicted in FIG. 7*b*. With reference to FIGS. 7*a*–8*b*, as the device 250 slides to the emergency condition, spherical protrusion 270 forces alarm trigger lever 214 away from U-shaped retaining portion 218, thereby rotating lever 214 about pivot 216 and releasing the alarm switch 220 to trigger the alarm.

To mechanically couple the device 250 with alarm pull-station 210, the installation procedure involves the following steps: (1) placing a portion of spherical protrusion 270 within trigger cavity 222 to facilitate engagement of protrusion 270 with alarm trigger lever 214 and plate 224, (2) placing slider 310 within U-shaped grooves 312, 314 of mounting plate 310, (3) arranging bolts 286–289 to couple rod structure 260 with slider 300 and mounting plate 310 (4) fixing mounting plate 310 to structure 212 via screws 220, 222, and (5) fixing cover 252 to structure 212 via screws 254. During placement of a portion of spherical protrusion 270 within trigger cavity 222 (Step 1), alarm trigger lever 214 may be slightly displaced. However, device 250 is disposed externally of alarm trigger lever 214, retaining portion 219 and plate 224 of alarm pull-station 210, thereby preserving the original internal operation and acceptability of the pull-station 210. Therefore, alarm pull-station 210 remains structurally unaltered during this coupling procedure and continues to operate in its original manner.

In can thus be seen that the present invention is directed to a new and improved system and method for adjusting the height at which an alarm may be triggered. The present invention can be produced economically and may be re-used on numerous occasions.

It should be understood by those skilled in the art that other forms of the applicants' invention may be made, all within the spirit of the invention and the scope of the appended claims. In particular, it is to be understood that the invention is not limited to the specific alarm pull-stations disclosed herein, but has applications to other alarm pull-stations without affecting the approved structure of the pull-stations.

What is claimed is:

1. A device for altering a height at which an alarm may be actuated while maintaining the structural integrity of said alarm, said alarm including a trigger cavity, the device comprising:

means for engaging an external portion of a trigger of said alarm, said engaging means disposed externally of said alarm, at least a portion of said means for engaging being dimensioned to be received within said trigger cavity;

means for moving said engaging means from a non-emergency condition to an emergency condition to trigger said alarm, said moving means extending outwardly from said alarm; and means for mounting said engaging means to a fixed structure.

2. The device of claim 1 wherein said engaging means comprises a T-shaped protrusion.

3. The device of claim 1 wherein said engaging means comprises a spherically shaped protrusion.

4. The device of claim 1 wherein said moving means comprises a slider having a hand-gripping portion.

5. The device of claim 1 wherein said mounting means comprises a mounting plate configured to receive at least a portion of said slider.

6. The device of claim 1 further comprising means for pulling said means for moving toward said means for mounting to prevent unwanted activation of said alarm.

7. A device for adjusting a height at which an alarm pull-station may be actuated, said alarm pull-station having an alarm trigger lever and a trigger cavity, comprising:

an alarm trigger operatively engageable with said alarm trigger lever of said alarm pull-station, wherein said alarm trigger has a T-shaped structure;

a rod operatively associated with said alarm trigger;

a hand-grip operatively associated with said alarm trigger; and a mounting portion operatively associated with said rod, said mounting portion being attached to a fixed structure;

wherein said device is disposed externally of said alarm pull-station and at least a portion of said alarm trigger is disposed within said trigger cavity, such that said portion of said alarm trigger pulls said alarm trigger lever as said portion of said alarm trigger is pulled downwardly along said fixed structure.

8. A device for adjusting a height at which an alarm pull-station may be actuated, said alarm pull-station having an alarm trigger lever and a trigger cavity, comprising:

an alarm trigger operatively engageable with said alarm trigger lever of said alarm pull-station, wherein said alarm trigger has a camming surface and a spherical shape;

a rod operatively associated with said alarm trigger;

a hand-grip operatively associated with said alarm trigger; and a mounting portion operatively associated with said rod, said mounting portion being attached to a fixed structure;

wherein said device is disposed externally of said alarm pull-station and at least a portion of said alarm trigger is disposed within said trigger cavity, such that said portion of said alarm trigger pulls said alarm trigger lever as said portion of said alarm trigger is pulled downwardly along said fixed structure.

9. A device for adjusting a height at which an alarm pull-station may be actuated, said alarm pull-station having an alarm trigger lever and a trigger cavity, comprising:

an alarm trigger operatively engageable with said alarm trigger lever of said alarm pull-station;

a rod operatively associated with said alarm trigger;

a hand-grip operatively associated with said alarm trigger; and a mounting portion operatively associated with said rod, said mounting portion being attached to a fixed structure;

a spring disposed between said hand-grip and a portion of said mounting portion to pull said hand-grip toward said portion of said mounting portion;

wherein said device is disposed externally of said alarm pull-station and at least a portion of said alarm trigger is disposed within said trigger cavity, such that said portion of said alarm trigger pulls said alarm trigger lever as said portion of said alarm trigger is pulled downwardly along said fixed structure.

10. A device for adjusting a height at which an alarm pull-station may be actuated, said alarm pull-station having an alarm trigger cavity, said alarm pull-station being mounted to a fixed structure, comprising:

an alarm trigger, at least a portion of said alarm trigger disposed within said alarm trigger cavity, said alarm trigger disposed externally of said alarm pull-station, wherein said alarm trigger has a T-shaped structure;

a rod extending from said alarm trigger, said rod disposed externally of said alarm pull-station;

a hand-grip extending from said rod, said hand-grip disposed externally of said alarm pull station;

wherein at least a portion of said device is mounted to said freed structure, and wherein said alarm trigger, rod and hand-grip are movable from a first position to a second position such that said alarm pull-station is unactuated when said alarm trigger, rod and hand-grip are in said first position and said alarm pull-station is actuated when said alarm trigger, rod and hand-grip are in said second position.

11. A device for adjusting a height at which an alarm pull-station may be actuated, said alarm pull-station having an alarm trigger cavity, said alarm pull-station being mounted to a fixed structure, comprising:

an alarm trigger, at least a portion of said alarm trigger disposed within said alarm trigger cavity, said alarm trigger disposed externally of said alarm pull-station, wherein said alarm trigger has a spherical structure;

a rod extending from said alarm trigger, said rod disposed externally of said alarm pull-station;

a hand-grip extending from said rod, said hand-grip disposed externally of said alarm pull station;

wherein at least a portion of said device is mounted to said fixed structure, and wherein said alarm trigger, rod and hand-grip are movable from a first position to a second position such that said alarm pull-station is unactuated when said alarm trigger, rod and hand-grip are in said first position and said alarm pull-station is actuated when said alarm trigger, rod and hand-grip are in said second position.

12. A device for adjusting a height at which an alarm pull-station may be actuated, said alarm pull-station having an alarm trigger cavity, said alarm pull-station being mounted to a fixed structure, comprising:

an alarm trigger, at least a portion of said alarm trigger disposed within said alarm trigger cavity, said alarm trigger disposed externally of said alarm pull-station;

a rod extending from said alarm trigger, said rod disposed externally of said alarm pull-station;

a second rod extending from said alarm trigger, said second rod disposed externally of said alarm pull-station;

a hand-grip extending from said rod, said hand-grip disposed externally of said alarm pull station;

wherein at least a portion of said device is mounted to said fixed structure, and wherein said alarm trigger, rod and hand-grip are movable from a first position to a second position such that said alarm pull-station is unactuated when said alarm trigger, rod and hand-grip are in said first position and said alarm pull-station is actuated when said alarm trigger, rod and hand-grip are in said second position.

13. The device of claim 12 further comprising a mounting plate attached to said fixed structure, said mounting plate having at least one U-shaped groove.

14. The device of claim 13 wherein at least a portion said hand-grip is disposed within said U-shaped groove.

15. A method for adjusting a height at which an alarm pull-station mounted on a fixed structure may be actuated, said alarm pull-station having an alarm trigger and a trigger cavity, said alarm trigger having an external portion for engagement by a user during an emergency, comprising the steps of:

maintaining said alarm pull-station in a structurally unaltered condition;

disposing an elongated apparatus externally of said alarm pull-station;

placing said elongated apparatus in external communication with said external portion of said alarm trigger of said alarm pull-station such that at least a portion of said elongated apparatus is disposed within said trigger cavity; and securing said elongated apparatus to a fixed structure.

16. The method of claim 15 wherein said portion of said elongated apparatus is a T-shaped protrusion extending from said elongated apparatus.

17. The method of claim 15 wherein said portion of Said elongated apparatus is a camming surface associated with said elongated apparatus.

18. The method of claim 17 wherein said camming surface is disposed on a spherically shaped protrusion extending from said elongated apparatus.

19. The method of claim 15 wherein said securing step comprises the step of:

securing at least a portion of said elongated apparatus to said fixed structure on which said alarm pull-station is mounted.

20. The method of claim 15 wherein said disposing step comprises the step of:

disposing a hand-gripping portion of said elongated apparatus downwardly from said alarm pull-station along said fixed structure to which said alarm pull-station is mounted.

21. The method of claim 15 further comprising: imparting a spring force between elements of said elongated apparatus to inhibit any portion of the elongated apparatus from sliding downwardly.

* * * * *